United States Patent [19]

Van Dusen et al.

[11] Patent Number: 4,739,825

[45] Date of Patent: Apr. 26, 1988

[54] APPARATUS FOR COOLING THE CORE OF A LIQUID COOLED TRANSFORMER

[75] Inventors: Morris V. Van Dusen, Clifton Park; Thomas E. Van Schaick, Burnt Hills; Ronald W. Tribley, Schenectady, all of N.Y.

[73] Assignee: General Electric Company, Schenectady, N.Y.

[21] Appl. No.: 818,649

[22] Filed: Jan. 14, 1986

[51] Int. Cl.[4] ..... H01F 27/10

[52] U.S. Cl. ..... 165/104.33; 336/60; 336/61; 165/170

[58] Field of Search ..... 165/104.33; 336/60, 336/61; 165/170

[56] References Cited

U.S. PATENT DOCUMENTS

| | | | |
|---|---|---|---|
| Re. 14,891 | 6/1920 | Johannesen | 336/60 |
| 1,912,903 | 6/1933 | Long | 336/60 |
| 2,547,065 | 4/1951 | Wadhams | 336/61 |
| 2,685,677 | 8/1954 | Paluev | 336/60 |
| 3,183,461 | 5/1965 | Tipton | 336/61 |
| 3,983,934 | 10/1976 | Lee | 165/170 |
| 4,039,990 | 8/1977 | Philp | 336/60 |
| 4,491,817 | 1/1985 | Koyama | 336/60 |

FOREIGN PATENT DOCUMENTS

| | | | |
|---|---|---|---|
| 1464356 | 3/1969 | Fed. Rep. of Germany | 336/60 |

*Primary Examiner*—Albert W. Davis, Jr.
*Attorney, Agent, or Firm*—Jerome C. Squillaro

[57] ABSTRACT

Apparatus for containing liquid coolant within a liquid cooled transformer includes a vessel having opposing sides for forming a chamber. The chamber is prevented from decreasing below a predetermined volume limit when compressive force is applied to the vessel by providing separation elements which are coupled to at least one of the sides and extend into the chamber for contacting the other side when the limit is reached, thereby preventing further volume reduction of the chamber. When a liquid under pressure is supplied to the chamber the vessel tends to expand, such that when the apparatus is disposed between laminations of a core of a transformer for cooling the transformer, force is exerted on the laminations, thereby ensuring that the laminations do not loosen under adverse operating conditions.

7 Claims, 3 Drawing Sheets

APPARATUS FOR COOLING THE CORE OF A LIQUID COOLED TRANSFORMER

BACKGROUND OF THE INVENTION

This invention relates to apparatus and method for cooling the core of a liquid cooled transformer and, more particularly, to apparatus for confining liquid cooling within the core of a liquid cooled transformer.

In design of an electrical transformer, it is generally desirable to optimize space utilization. That is, a transformer having a predetermined rating should be as small as physically possible, consistent with accepted electrical design principles. A major consideration, and a factor that often prohibits reducing the size of the transformer below a predetermined limit, is the amount of heat generated in the transformer during operation. Several schemes have been used to augment cooling of transformers over that available by using the ambient environment. One such technique employs a gas cooled transformer, such as is disclosed in U.S. Pat. No. 4,477,767 - Cotzas, assigned to the present assignee, wherein the transformer is disposed in a cooling dome of a large dynamoelectric machine for beneficially using the cooling fluid, typically hydrogen gas, used to cool the rotor of the dynamoelectric machine. However, gas cooled transformers typically require internal passageways and vents for permitting the coolant gas to flow therethrough and directly to contact the laminations of the transformer core. (The core of a transformer is typically fabricated from a plurality of stacked laminations in order to reduce eddy currents and heat resulting therefrom. The laminations are generally tightly compressed together during fabrication to ensure adequate surface contact with adjacent laminations and to minimize overall size). These passageways, or ducts, increase the overall physical size of the transformer over that possible using a more efficient, (i.e. one having a higher thermal conductivity) heat exchange medium, such as a liquid like water, and/or require space which could beneficially be used to provide additional laminations for the transformer core, thereby increasing the rating of the transformer within the same sized outer housing.

Another technique for cooling transformers uses a liquid, such as water, or preferably deionized or distilled water. In certain applications, it is desirable that the water not directly contact the laminations of the transformer core. In order to contain the water within the transformer without having the water directly contact the core laminations, yet still be in heat flow communication with the laminations, a chamber, which may be disposed between core laminations and in heat flow communication therewith, is provided. To minimize the size of the chamber and to optimize heat flow between the laminations of the transformer core and liquid within the chamber, it is desirable to minimize the thickness of the chamber walls. However, during fabrication of the transformer core, it is necessary that the laminations, having chambers predeterminedly spaced therebetween, be compressed in order to minimize the spacing between individual laminations and the overall size of the core. Forces involved in such compression tend to crush the side walls of the chamber, thus reducing the volume for liquid flow through the chamber and thereby reducing the cooling effectiveness of the chamber. In addition, in order to ensure tightly packed core laminations, especially during operation of the transformer, it would be desirable to utilize pressure available from the liquid coolant to beneficially exert compressive force on the laminations.

During operation, magnetostrictive forces, caused in part by eddy currents induced in laminations of the core, act to separate and vibrate the laminations. It is desirable to maintain the tightness and compactness of core laminations achieved during core assembly since loose laminations tend to vibrate. This vibration may cause fretting, wear and excessive or undesirable noise, and looseness may detrimentally reduce heat conduction through the core.

Accordingly, it is an object of the present invention to provide means and method for containing a liquid in heat flow communication with the laminations of a transformer core without succumbing to assembly compressive forces used to fabricate the core.

Another object of the present invention is to provide means and method during operation of the transformer for augmenting compressive forces on laminations of a transformer core, which forces are used to fabricate the core.

SUMMARY OF THE INVENTION

In accordance with the present invention, in a liquid-cooled transformer heat exchange means disposed in heat flow communication with the core of the transformer comprise a pair of opposed spaced apart members for forming a liquid chamber therebetween, separation means coupled to at least one of the members for preventing reduction of the size of the chamber below a predetermined limit whenever the members are subjected to force tending to reduce the size of the chamber, and liquid delivery and extraction means coupled to the chamber for respectively introducing and removing liquid from the chamber. The heat exchange means may beneficially expand when a liquid under pressure is supplied to the chamber, such that residual compressive forces due to assembly compressive forces applied to the laminations during core fabrication are augmented. The separation means may combine a plurality of dimples, or embossments, which may be arranged in a predetermined pattern for ease of manufacture.

Further, a method for fabricating a liquid-cooled electrical transformer comprises: disposing heat exchange means having a chamber for receiving a liquid coolant between two laminations, the laminations for forming at least a part of the core; adding additional laminations sufficient to provide desired electrical and magnetic characteristics of the core; compressing the heat exchange means, two laminations and additional laminations together with an assembly compressive force so that a sandwich-like arrangement is formed; preventing reduction of the size of the chamber below a predetermined limit by providing separation means coupled to said heat exchange means and extending into the chamber; placing primary coil means and secondary coil means in magnetic flux communication with the sandwich-like arrangement and securing the sandwich-like arrangement so that a residual compressive force is substantially maintained after the assembly compressive force is removed. Also, the residual compressive force may be augmented by introducing a coolant liquid under pressure into the chamber, thereby causing the heat exchange means to expand.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
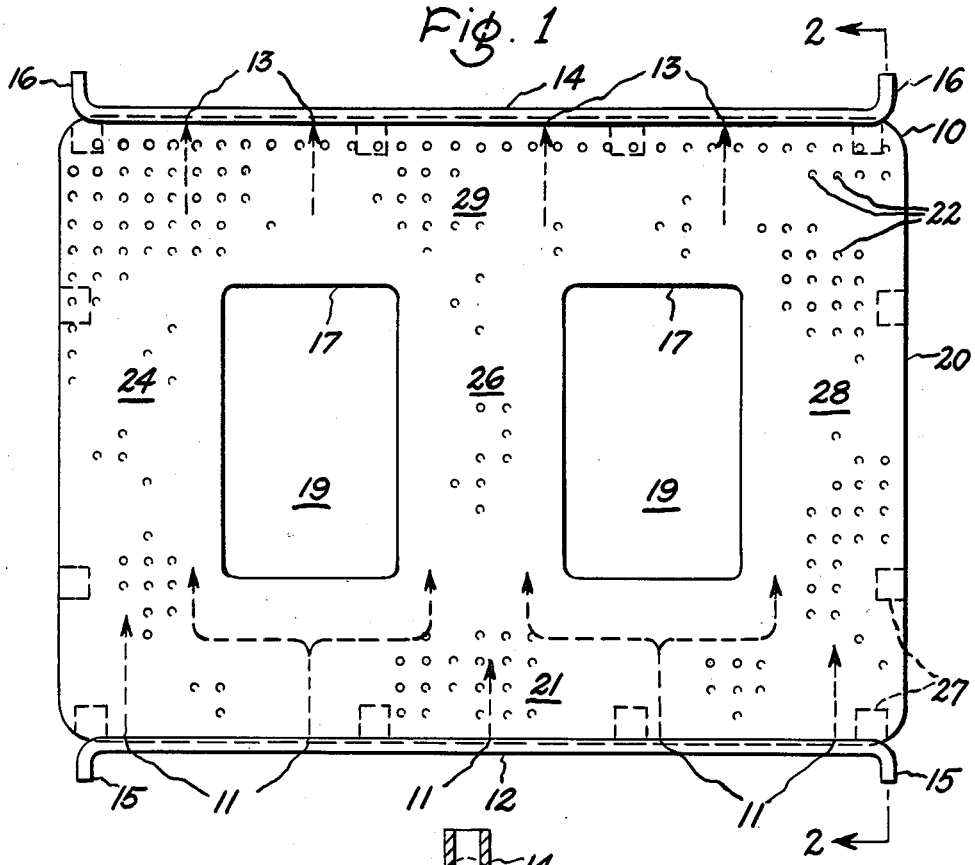
FIG. 1 is an elevation view of a liquid vessel for use with a liquid cooled transformer in accordance with the present invention.
Figure 2:
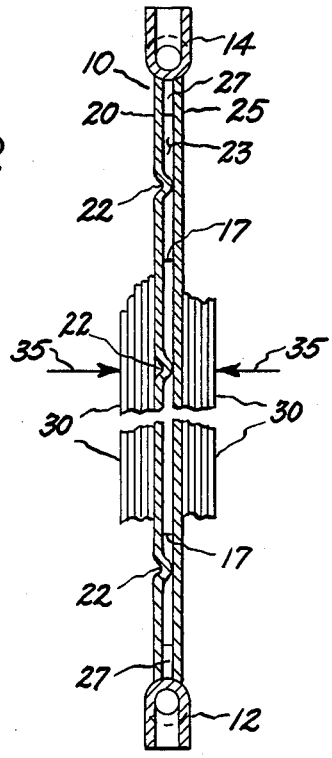
FIG. 2 is a view looking in the direction of the arrows of line 2—2 of FIG. 1.

Referring to the drawing, and especially to FIGS. 1 and 2 thereof, a vessel 10 for containing liquid coolant of a liquid cooled transformer is shown. Vessel 10 comprises a pair of substantially parallel spaced apart plates 20 and 25 for forming a chamber, or interplate spacing, 23 therebetween, liquid delivery means 12, such as an input header, having a pair of liquid input ports 15 and liquid extraction means 14, such as an output header, having a pair of liquid output ports 16. Of course, a single input port 15 and a single output port 16 may be used if desired. Alternatively, plate 20 and 25 may be integral with each other and bent or folded along one edge to form the desired configuration. Header 12 is preferably secured along one edge of vessel 10 and includes output flow means 11, such as predeterminedly spaced holes, for providing liquid flow communication between header 12 and chamber 23. Header 14 is preferably secured to an edge of vessel 10 opposite header 12 and includes input flow means 13, such as a plurality of predeterminedly spaced holes, in liquid flow communication with chamber 23. Output flow means 11 and input flow means 13 may each respectively include a longitudinal void along the length of input header 12 and output header 14, respectively. However, it is believed that holes 11 and 13 provide better liquid flow control and flow distribution through chamber 23. When operationally oriented in a transformer, it is preferred that input header 12 be disposed lower than output header 13 so that relatively cold liquid entering header 12 must move against the force of gravity in order to reach header 13, thereby carrying relatively hot liquid from chamber 23 to header 13 and eventually to output port 16. A plurality of spacers 27 may be predeterminedly disposed between plate 20 and 25 around the periphery of vessel 10 in order to maintain the appropriate size of chamber 23, especially during fabrication of chamber 23, when the periphery of plates 20 and 25 are sealed together such as by welding.

Plates 20 and 25, which may be substantially flat, comprise a material, such as a metal, having good thermal conductivity and are sealed around the edges of vessel 10, such as by welding, in order to confine liquid to chamber 23. Plates 20 and 25 include a pair of mutually registerable segmenting means, or holes, 19 for forming cutouts 17 to receive windings of the transformer. Cutouts 17 are also sealed around their edges, such as by welding, in order to confine liquid to chamber 23. Cutouts 17 physically divide vessel 10 into regions which may be designated as legs 24, 26 and 28 and transversely extending yokes 21 and 29, respectively connecting opposite ends of legs 24, 26 and 28. Legs 24, 26 and 28 typically accommodate transformer windings for a respective phase of the transformer. Thus, the embodiment shown would typically be used with a three-phase transformer. A similar vessel 10 may be fabricated for a single-phase transformer in which case cutouts 17 would not be necessary. In general, the overall shape of vessel 10 is configured to be similar to that of the laminations of the core of the transformer with which vessel 10 cooperates in order to provide maximum surface contact between the laminations and vessel 10 for optimum heat transfer, while permitting windings of the transformer to be appropriately disposed for obtaining desired magnetic flux communication with the core of the transformer.

As shown in FIG. 1 and more particularly in FIG. 2, plate 20 includes a plurality of separation means 22, such as dimples or upsets, directed into chamber 23 and toward the inner surface of plate 25. Dimples 22 are appropriately spaced over the surface of plate 20 (such as in a rectangular grid pattern for ease of manufacture) and extend far enough toward the inner surface of plate 25 to maintain chamber 23 at an adequate volume when compressing the laminations and vessel 10 during assembly of the core of the transformer to permit an appropriate flow of coolant through chamber 23. Although separation means 22 are illustrated as originating from, or attached to plate 20, they may likewise originate from, or be attached to plate 25, or a combination may be used such that a predetermined first and second portion of separation means 22 originates from, or is attached to, each of plate 20 and 25, respectively.

During assembly of the transformer core, assembly compressive forces in a direction indicated by arrows 35 are exerted on core laminations 30 (shown in part for reference) having vessel 10 disposed therebetween and these assembly compressive forces tend to crush plates 20 and 25 together, thus reducing the volume of, or entirely eliminating, chamber 23. However, dimples 22, which may be any shape, but are preferably conical for ease of manufacture (such as by punching), are adequately and appropriately spaced over the inner surface of plate 20 to prevent assembly compressive forces 35 from reducing the volume of chamber 23 below a predetermined limit. During core assembly, dimples 22 may contact the inner surface of plate 25 when the predetermined volume or size limit of chamber 23 is attained, thereby preventing further reduction in the volume of chamber 23. However, dimples 22 remain free from and do not attach or become secured to the inner surface of plate 25.

A further benefit of vessel 10 is achieved during operation. Once the transformer has been assembled and the sandwich-like arrangement of laminations 30 and vessel 10 has been secured so that a residual compressive force is substantially maintained after assembly compressive force 35 is removed, liquid coolant may be applied to input header 12. The pressure of liquid coolant in chamber 23 then may be controlled such that liquid coolant pressure tends to force plates 20 and 25 apart, thereby increasing the residual compressive forces on core laminations 30 and vessel 10.

Separation means 22 may alternatively include ribs secured to or intergral with the inner surface of plate 20. However, dimples or upsets 22 are preferred since they are easy to manufacture and offer minimum flow restriction to liquid coolant in chamber 23. Ribs may be employed where it is desired to provide positive liquid flow control, such as for directing liquid coolant to an anticipated hot spot of vessel 10, since they generally provide better directional control of liquid flow than upsets 22.

Figure 3:
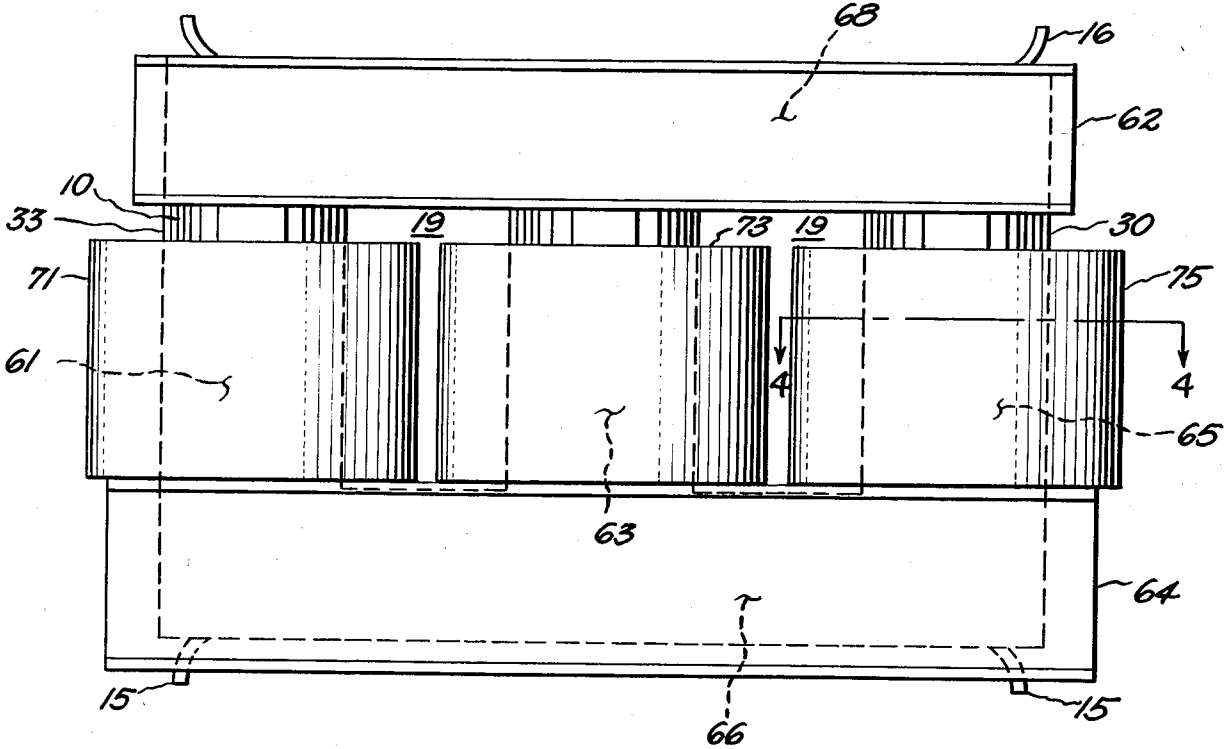
FIG. 3 is an elevation view of a liquid cooled transformer in accordance with the present invention.

Referring to FIG. 3, an elevation view of a liquid cooled three-phase transformer in accordance with the present invention is shown. The transformer comprises a plurality of laminations 30 forming a core 33 that includes legs 61, 63 and 65 and yokes 66 and 68, coils 71, 73 and 75 respectively surrounding legs 61, 63 and 65, and a respective pair of clamping channels 62 and 64, which may be metal but do not form any part of the electrical or magnetic circuit of the transformer, respectively disposed on opposite sides of yoke 68 and 66 for securely clamping and compressing laminations 30 and vessels 10 together.

Figure 4:
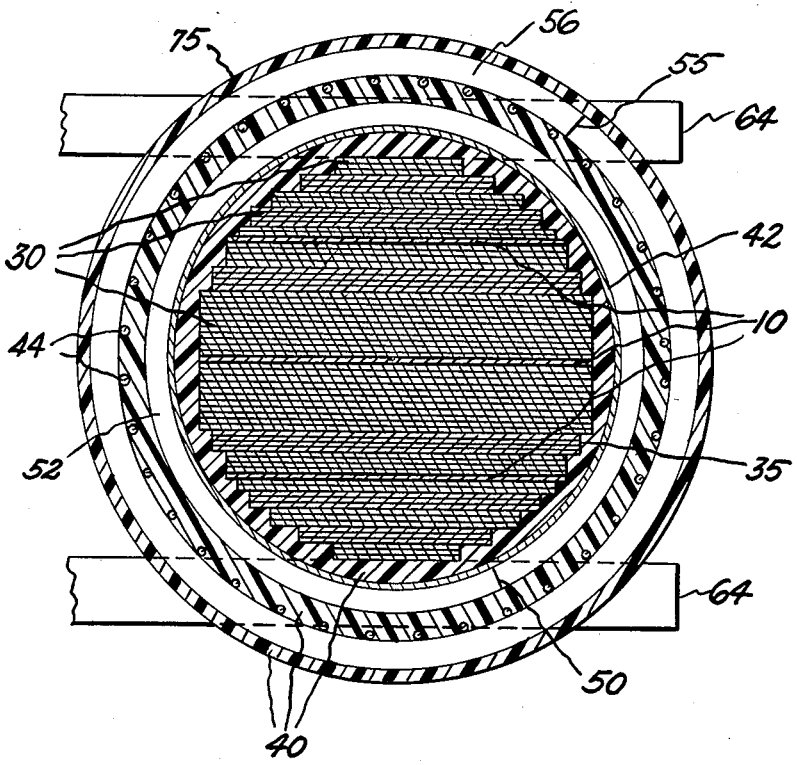
FIG. 4 is a view looking in the direction of the arrows of line 4—4 of FIG. 3.

Referring to FIG. 4, a sectional view of a liquid cooled transformer of FIG. 3 is shown. Transformer core 33 includes a plurality of laminations 30, predeterminedly arranged in sections, and a plurality of vessels 10, predeterminedly spaced between laminations 30. Of course a single vessel 10 may be used where appropriate and where adequate cooling may be obtained by a single vessel 10. Coil 75 includes a winding drum 42 circumferentially surrounding and spaced from laminations 30 and vessels 10. Inner electrical conductor 50 of a first, or primary, winding means 52 circumferentially surrounds winding drum 42 and an outer electrical conductor 55 is spaced from and circumferentially surrounds inner conductor 50 to form a second, or secondary, winding means 56. Primary winding means 52 and secondary winding means 56 are disposed in electromagnetic flux communication with transformer core 33. Support means 44, such as glass rods, may be disposed between inner conductor 50 and outer conductor 55. Further, the space between winding drum 42 and transformer core 33, the space between primary winding means 52 and secondary winding means 56, and the space outwardly circumferentially surrounding secondary winding means 56 may be filled with retaining means 40, such as epoxy resin, for encapsulation and provision of required structural support to the transformer. Further, retaining means 40 secures laminations 30 and vessels 10 of core 33 such that a residual compressive force is substantially maintained after assembly compressive force 35 (FIG. 2) is removed. To fabricate core 33, heat exchange means 10, having a chamber 23 for receiving liquid coolant is disposed between two laminations and additional laminations 30 for forming the core 33 are added to provide the desired electrical and magnetic characteristics of core 33. Laminations 30 and included heat exchange means 10 are compressed together with an assembly compressive force so that a sandwich-like arrangement is formed. Reduction of the volume of chamber 23 below a predetermined limit is prevented by providing separation means, such as dimples coupled to heat exchange means 10 and extending into chamber 23. The sandwich-like arrangement is secured so that a residual compressive force remains after removal of the assembly compressive force. The residual compressive force may be augmented by introducing at a pressure greater than ambient into the chamber, thereby causing the heat exchange means to expand. Coils 71 and 73 may be fabricated analogously to coil 75.

This liquid cooled configuration permits dense packing of laminations 30 without need of gas flow chambers or ducts, since heat from the core is more effectively removed than with a gas cooled transformer and therefore this configuration permits the rating of a transformer in accordance with the present invention to be increased over the same size transformer using gas coolant and/or the overall size of a transformer having the same rating as a gas cooled transformer to be decreased. Further, operation of the transformer in accordance with the present invention permits liquid coolant pressure to augment compressive forces in the transformer core, thereby ensuring tightly packed laminations during operation.

Thus has been illustrated and described means and method for containing a liquid coolant in heat flow communication with the laminations of a transformer core without succumbing to compressive forces used to fabricate the core and for augmenting assembly compressive forces during operation of the transformer.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In a liquid-cooled electrical transformer having a core, heat exchange means disposed in the core for cooling the core, the heat exchange means comprising:

a pair of opposed spaced apart members for forming a liquid chamber therebetween;

separation means coupled to at least one of the members for preventing reduction of the volume of the chamber below a predetermined limit whenever said pair of members is subjected to force tending to reduce the volume of the chamber; said separation means comprising dimples extending into the chamber;

liquid delivery means coupled to the chamber for introducing liquid into the chamber; and liquid extraction means coupled to the chamber for removing liquid from the chamber, wherein at least a portion of the liquid within the chamber is in heat flow communication with the core for removing heat from the core, thereby cooling the core.

2. The heat exchange means as in claim 1, wherein the pair of members each comprise a substantially flat plate.

3. The heat exchange means as in claim 2, wherein the pair of members are integral each other.

4. The heat exchange means as in claim 2, wherein the transformer is a 3-phase transformer, the core having one leg per phase and further wherein each plate includes a pair of mutually registrable segmenting means for dividing the heat exchange means to form three legs, the three legs respectively coupled to the leg per phase of the core.

5. The heat exchange means as in claim 1, wherein the dimples are coupled to only one of the pair of members.

6. A liquid-cooled electrical transformer comprising:

core means formed at least in part from a plurality of laminations;

primary coil means disposed in magnetic flux communication with said core means;

secondary coil means disposed in magnetic flux communication with said core means;

heat exchange means disposed in said core means and further disposed between two laminations of the core, said heat exchange means including a pair of opposing spaced apart members for forming a liquid chamber, the liquid chamber having liquid input and output means for respectively introducing and removing liquid from the chamber, at least one of the members including separation means comprising a plurality of dimples extending into the chamber from one of the members and contacting the other of the members for reventing reduction of the volume of the chamber below a redetermined limit whenever the pair of members is subjected to a force tending to reduce the volume of the chamber.

7. The transformer as in claim 6, further including a plurality of heat exchange means disposed between respective other laminations, the plurality of heat exchange means separated by at least one lamination.

* * * * *